United States Patent [19]

Yokoyama

[11] Patent Number: 4,653,096

[45] Date of Patent: Mar. 24, 1987

[54] DEVICE FOR FORMING A SIMULATED STEREOPHONIC SOUND FIELD

[75] Inventor: Kenji Yokoyama, Hamamatsu, Japan

[73] Assignee: Nippon Gakki Seizo Kabushiki Kaisha, Hamamatsu, Japan

[21] Appl. No.: 711,813

[22] Filed: Mar. 14, 1985

[30] Foreign Application Priority Data

Mar. 16, 1984 [JP] Japan ..... 59-38842[U]
Apr. 25, 1984 [JP] Japan ..... 59-84910

[51] Int. Cl.[4] ..... H04R 5/00

[52] U.S. Cl. ..... 381/17; 381/63; 84/DIG. 26

[58] Field of Search ..... 381/1, 17, 18, 62, 63; 84/1.24, DIG. 26, DIG. 4

[56] References Cited

U.S. PATENT DOCUMENTS 4,239,939 12/1980 Griffis ..... 381/17

*Primary Examiner*—Forester W. Isen
*Attorney, Agent, or Firm*—Spensley Horn Jubas & Lubitz

[57] ABSTRACT

A device for forming a stereophonic sound field in a simulated fashion constructed in the form of a monophonic-to-stereophonic conversion circuit in which a monophonic signal is applied to cascade-connected twin-T circuits having different null point frequencies and an output signal of the twin-T circuits is provided as one stereophonic channel signal whereas an output obtained by substracting the one stereophonic channel signal from the monophonic signal is provided as the other stereophonic channel signal. A low-frequency signal attenuating resistor and a high-frequency signal attenuating filter are provided on the output side of the twin-T circuits to equalize peak values in frequency characteristics of the output signal of the twin-T circuits and thus obtained signal is amplified to be equalized in peak level to the monophonic signal and thereafter is applied to a subtractor together with the monophonic signal. Such conversion circuit may be used in a simulated 4-channel stereophonic reproduction device in which a difference signal is produced from a 2-channel stereophonic signal and rear 2-channel stereophonic signals are produced on the basis of this difference signal, and the conversion circuit is applicable to such production of the rear 2-channel stereophonic signals from the difference signal.

12 Claims, 12 Drawing Figures

DEVICE FOR FORMING A SIMULATED STEREOPHONIC SOUND FIELD

BACKGROUND OF THE INVENTION

This invention relates to a device for forming a simulated stereophonic sound field, i.e., a device for forming a sound field having a conversion circuit converting a monophonic signal to a stereophonic signal.

Known in the art is a conversion circuit as shown in FIG. 1 which converts a monophonic signal to a stereophonic signal. In this circuit, two twin-T circuits $T_1$, $T_2$ are cascade-connected and a monophonic signal is applied to an input terminal 1. A signal H(S) outputted by the twin-T circuits $T_1$, $T_2$ is derived from an output terminal 2 as a right channel signal whereas a signal 1-H(S) which is obtained by subtracting the output signal H(S) of the twin-T circuits $T_1$, $T_2$ from the input signal in a subtractor 3 is derived from an output terminal 4 as a left channel signal.

FIG. 2 shows frequency characteristics of the right channel signal H(S) and the left channel signal 1-H(S). These signals H(S) and 1-H(S) have frequency characteristics which are complementary to each other. More specifically, frequency components in the vicinity of frequencies $f_1$ and $f_2$ are reproduced mainly from the left channel and frequency components below the frequency $f_1$, above $f_2$ and in the vicinity of a peak frequency f' between the frequencies $f_1$ and $f_2$ are reproduced mainly from the right channel. Such separation of the frequency band into the right and left channels in reproduction of sound can simulate a stereophonic reproduction. For example, assuming that $f_1 = 150$ Hz and $f_2 = 4.5$ kHz, f' becomes about 1 kHz in which case bass is reproduced mainly from the left channel and soprano mainly from the right channel.

In the circuit of FIG. 1, however, the output signal H(S) which has passed the twin-T circuits $T_1$, $T_2$ is attenuated, due to filtering operations of both circuits $T_1$ and $T_2$, in a section between the two null points as shown in FIG. 2. If, for example, the frequencies $f_1$ and $f_2$ are set at the above described values, the level between the two null points drops by about 12 dB. Likewise, the left channel signal 1-H(S) obtained by subtracting the right channel signal H(S) from the input signal also has its peak level deviated from 0 dB. Accordingly, the respective peak values in frequency characteristics of the signals H(S) and 1-H(S) of the respective channels do not match with one another at 0 dB so that imbalance occurs in the frequency band.

There has also been known a device as shown in FIG. 3 which converts 2-channel stereophonic signals to 4-channel stereophonic signals in a simulated fashion. Left and right channel signals of 2-channel stereophonic signals are applied to input terminals 10 and 12. These left and right channel signals are applied directly to front left and right loudspeakers 24 and 26 through power amplifiers 16 and 22. The left and right channel signals are also applied to a reverberation imparting circuit 32 to produce sounds imparted with an artificial echo and the output signals of the reverberation imparting circuit 32 are applied to rear left and right channel loudspeakers 28 and 30 through power amplifiers 18 and 20. According to this construction, since sounds produced from the front loudspeakers are the input 2-channel stereophonic signals themselves, little error is produced in localization and a sound free from unnaturalness can be obtained. This type of prior art circuit however has the disadvantages that the sound produced tends to lack in feeling of presence when the imparting of reverberation is not suitably made, that unnaturalness occurs in the sound produced from the rear loudspeakers and that use of a delay circuit in the reverberation imparting circuit makes the construction of the circuit complicated and realization of reduced distortion factor difficult.

SUMMARY OF THE INVENTION

It is an object of the invention to provide a device for forming a sound field comprising cascade-connected twin-T circuits to produce complementary subsignals and having peak values in frequency characteristics of respective signals equalized with a resulting balanced frequency band.

It is another object of the invention to provide a device for forming a sound field adapted for use as a 4-channel stereophonic signal reproducing device having a simplified circuit construction for producing rear sounds with low distortion.

It is still another object of the invention to provide a device for forming a sound field adapted for use as a 4-channel stereophonic signal reproducing device capable of forming a sound field free from unnaturalness and filled with feeling of presence.

According to the invention, in cascade-connecting a plurality of twin-T circuits having different null point frequencies, peak values in frequency characteristics are caused to be equalized with one another by decreasing frequency characteristics outside of the section between the null points in correspondence to decrease in the frequency characteristics of the section between the null points. For achieving this, the frequency characteristics on the lower frequency side are decreased by a low frequency signal attenuating element whereas the frequency characteristics of the higher frequency side is decreased by a high frequency signal attenuating element.

In another aspect of the invention, in preparing rear sounds in a simulated fashion when the device is used as a 4-channel stereophonic signal reproducing device, the above described construction is utilized to produce rear 2-channel stereophonic signals from a difference signal between input 2-channel stereophonic signals.

DESCRIPTION OF PREFERRED EMBODIMENTS

Figure 1:
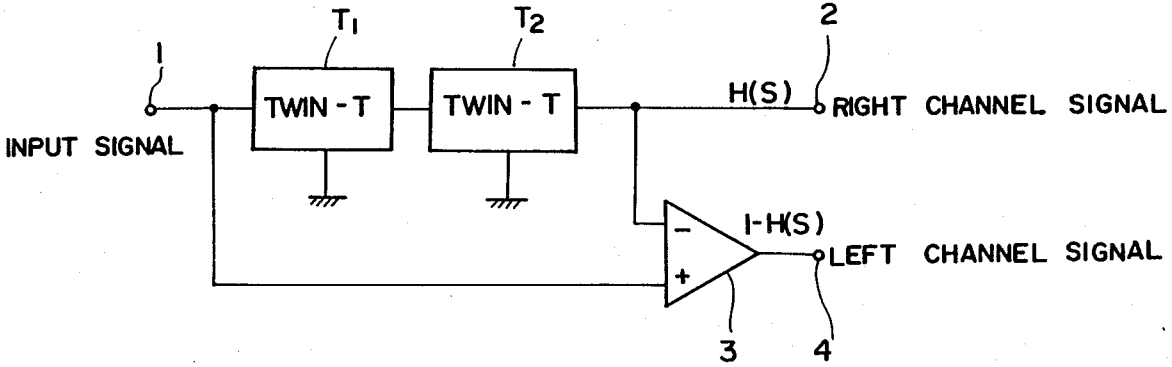
FIG. 1 PRIOR ART
FIG. 1 is a circuit diagram showing the prior art monophonic-stereophonic conversion circuit.
Figure 2:
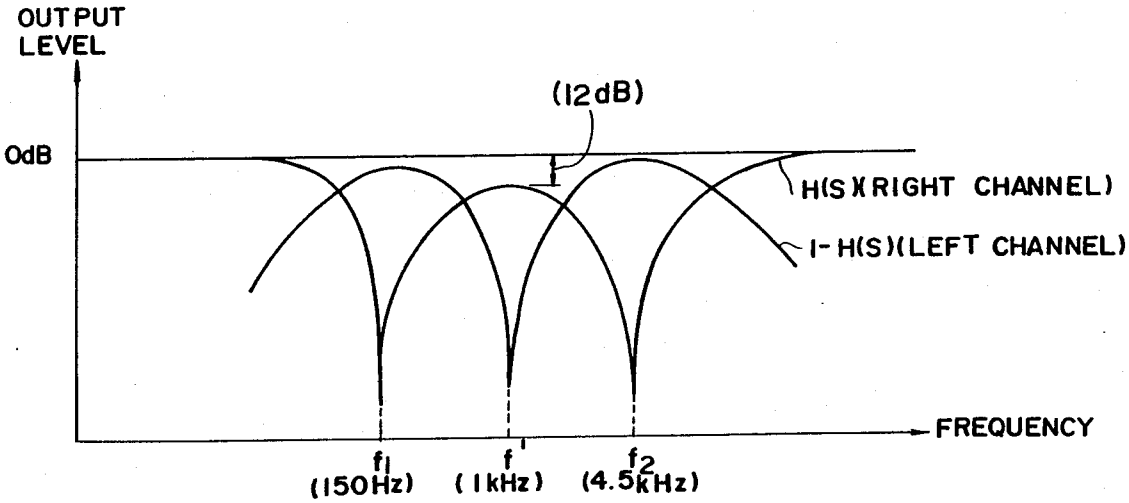
FIG. 2 PRIOR ART
FIG. 2 is a diagram showing frequency characteristics of output signals of the circuit shown in FIG. 1.
Figure 4:
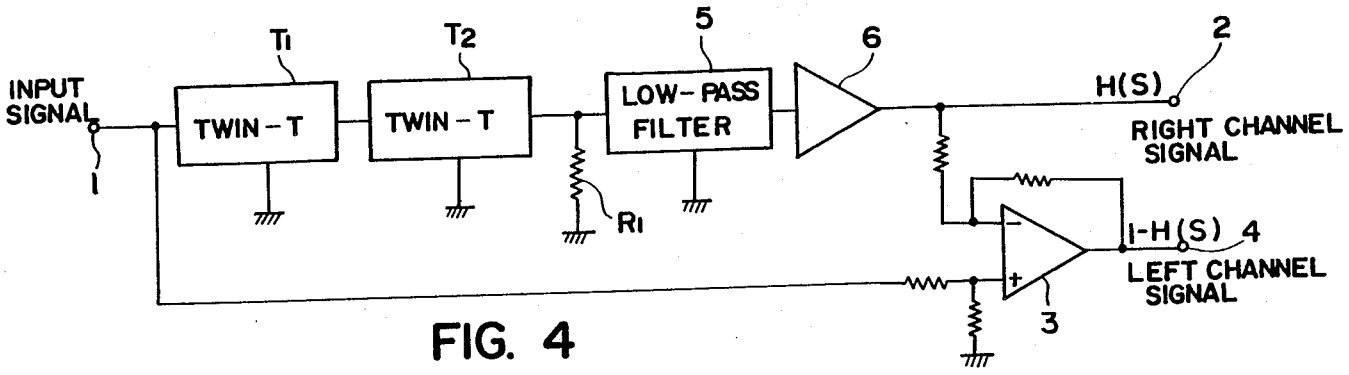
FIG. 4 is a block diagram showing an embodiment of the invention.

An embodiment of the invention is shown in FIG. 4. In this embodiment, the same component parts as in the prior art circuit of FIG. 1 are designated by the same reference characters.

In FIG. 4, two cascade-connected twin-T circuits $T_1$, $T_2$ are connected to an input terminal 1. On the output side of the twin-T circuits $T_1$, $T_2$ are serially connected a resistor $R_1$ and a low-pass filter 5. The resistor $R_1$ is provided for decreasing the peak value of the frequency band below the frequency $f_1$ to the peak value between the frequencies $f_1$ and $f_2$. The low-pass filter 5 is provided for decreasing the peak value of the frequency band above the frequency $f_2$ to the peak value between the frequencies $f_1$ and $f_2$. The signal having the equalized peak values obtained through the resistor $R_1$ and the low-pass filter 5 is derived from an output terminal 2 as the right channel signal H(S) through an amplifier 6. The amplifier 6 equalizes the signal level with that of the input signal before conducting the subtraction, reinforcing the level by the amount of decrease in the peak level to compensate for the decrease in the level. If, for example, there is decrease of −12 dB, the amplifier 6 is so set that it will have a gain of 12 dB.

The subtractor 3 subtracts the output signal H(S) of the amplifier 6 from the signal applied to the input terminal 1 and delivers difference 1-H(S) to the output terminal 4 as the left channel signal.

Figure 5:
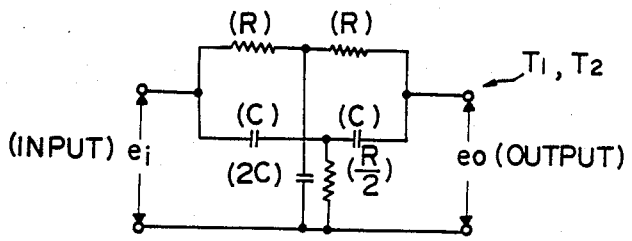
FIG. 5 is a circuit diagram showing the construction of the twin-T circuits.

An example of construction of the twin-T circuits $T_1$, $T_2$ is shown in FIG. 5. Each of these circuits is composed by combining resistors and capacitors as shown in the figure and its transmission characteristics is $$\frac{e_o}{e_i} = \frac{S^2 + 1}{S^2 + j4S + 1}$$

$$\left(S = j\frac{W}{W_o},\ W = 2\pi f,\ W_o = \frac{1}{CR}\right).$$

Q is $\frac{1}{4}$.

Figure 6:
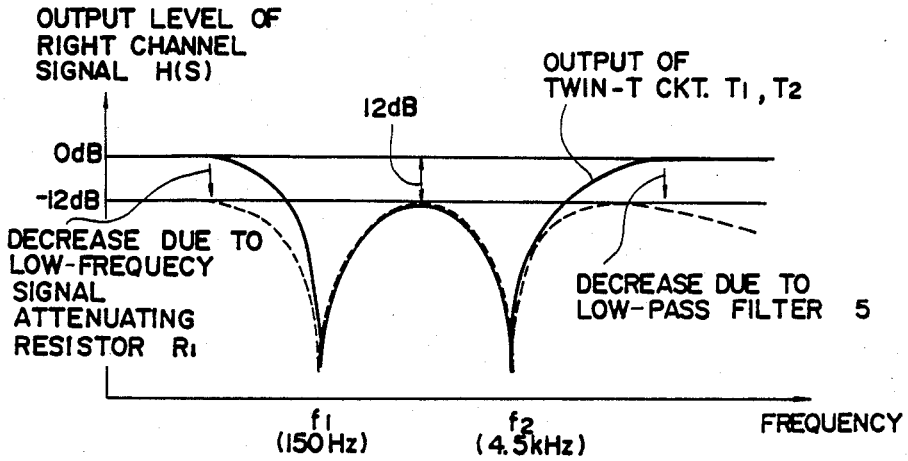
FIGS. 6(*a*) through 6(*c*) are diagrams for explaining the operation of the circuit shown in FIG. 4.
Figure 6:
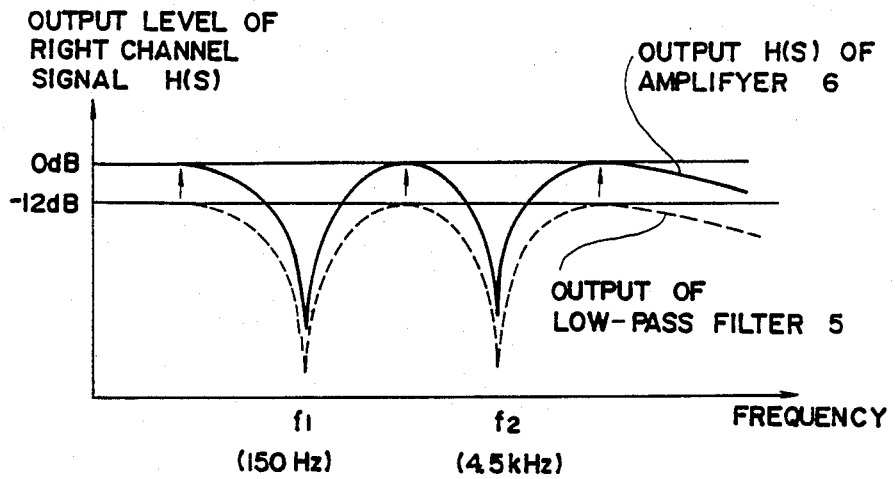
Figure 6:
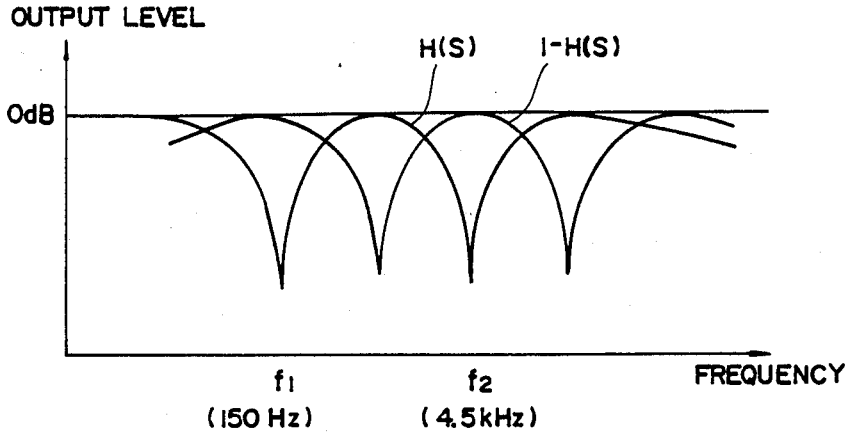

According to the circuit of FIG. 4, the level of the output of the twin-T circuits $T_1$, $T_2$ in the section between the two null points is decreased as in the prior art circuit. Assuming $f_1 = 150$ Hz and $f_2 = 4.5$ kHz, the level drops by about 12 dB as shown by a solid line in FIG. 6(*a*) and therefore the peak values in frequency characteristics do not match each other. The output of the twin-T circuits $T_1$, $T_2$ has been attenuated in the low frequency below the frequency $f_1$ by passing the low frequency signal attenuating resistor $R_1$ and has been attenuated in the high frequency above the frequency $f_2$ by passing through the low-pass filter 5 so that the signal provided from the low-pass filter 5 has been attenuated in its entire frequency band by −12 dB as shown by a broken line in FIG. 6(*a*) with a result that the peak values thereof are equalized at −12 dB. Accordingly, by amplifying the output of the low-pass filter 5 by 12 dB, i.e. the amount of attenuation, by the amplifier 6, a signal whose peak values are equalized at 0 dB as shown in FIG. 6(*b*) is obtained. This enables the peak value of the output signal of the subtractor 3 to be also equalized at 0 dB. Thus, the right and left channel signals H(S) and 1-H(S) whose respective peak values are equalized at 0 dB as shown in FIG. 6(*c*) and which thereby are well balanced in the frequency band are obtained from the output terminals 2 and 4.

Figure 7:
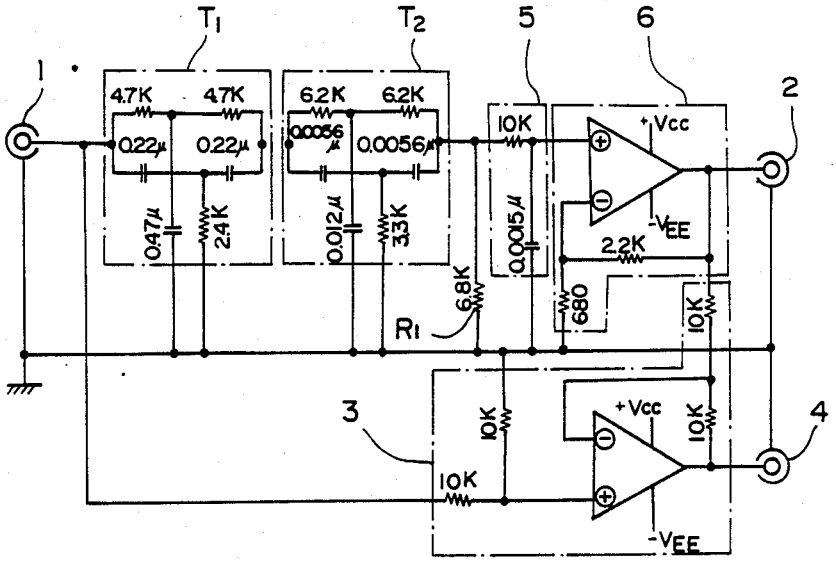
FIG. 7 is a circuit diagram showing specific example of the circuit of FIG. 4.

A specific example of the circuit of FIG. 4 is shown in FIG. 7. In the circuit of FIG. 7, the frequencies $f_1$ and $f_2$ are set at $f_1 = 150$ Hz and $f_2 = 4.5$ kHz and the output derived from the twin-T circuits $T_1$, $T_2$ in the section between the two null points has its level attenuated by 12 dB. Since the low frequency signal attenuating resistor $R_1$ is set at 6.8 kΩ in this example, characteristics which have been attenuated in the frequency band below $f_1$ by $$\frac{6.8\ k\Omega}{4.7\ k\Omega \times 2 + 6.2\ k\Omega \times 2 + 6.8\ k\Omega} = 0.238 \approx 12\ \text{dB}$$

is obtained. The cut-off frequency of the low-pass filter 5 is set at 15 kHz whereby characteristics whose peak value has been attenuated by −12 dB in the frequency band above $f_2$ is obtained. Accordingly, the output of the low-pass filter 5 is a signal attenuated in its entire frequency range by 12 dB. The amplifier 6 is so designed that it has a gain of about 12 dB and amplifies the output of the low-pass filter 5 by 12 dB to make its peak value 0 dB. The subtractor 3 subtracts the output of the amplifier 6 from the input signal and thereupon produces a signal which is complementary to the output of the amplifier 6 and has a peak value of 0 dB.

Figure 8:
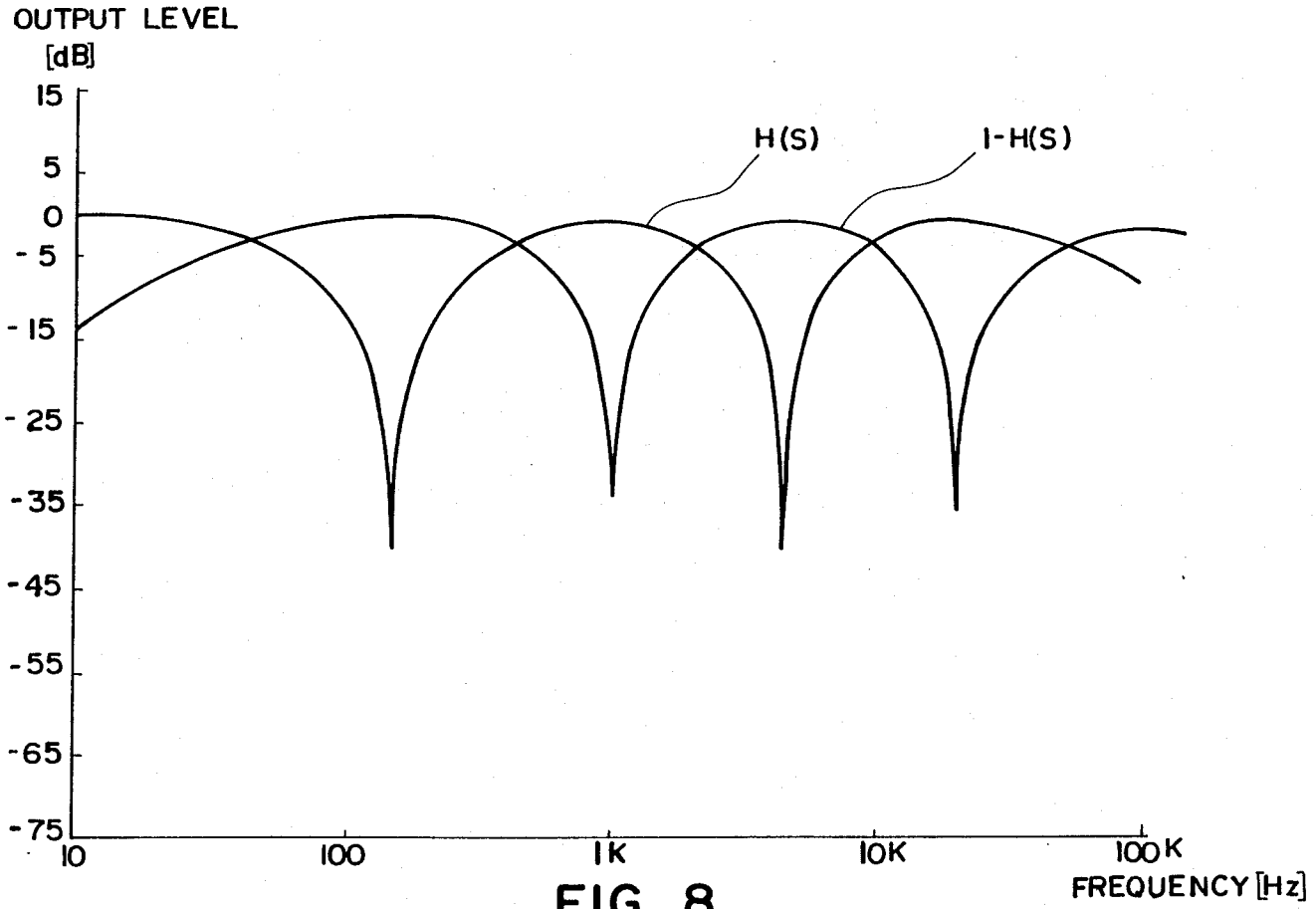
FIG. 8 is a diagram showing frequency characteristics of output signals of the circuit of FIG. 7.

FIG. 8 shows frequency characteristics of the right and left channel signals H(S) and 1-H(S) obtained in the circuit of FIG. 7.

In the above described embodiment, a couple of twin-T circuits are provided. The invention however is applicable also to a circuit in which three or more twin-T circuits are provided.

In the above described embodiment, the amplifier 6 is provided on the output side of the low-pass filter 5 to amplify the output signal of the low-pass filter 5 by 12 dB. Since the amplifier 6 is provided for equalizing the levels of the input signal and the signal H(S) before the subtraction, an attenuator may alternatively be provided on the input side of the subtractor 3 to attenuate the input signal to the subtractor 3 by 12 dB.

Next to be described is an embodiment in which the above described sound field forming device is utilized for producing rear sounds in a device reproducing 4-channel stereophonic signals in a simulated fashion.

Figure 3:
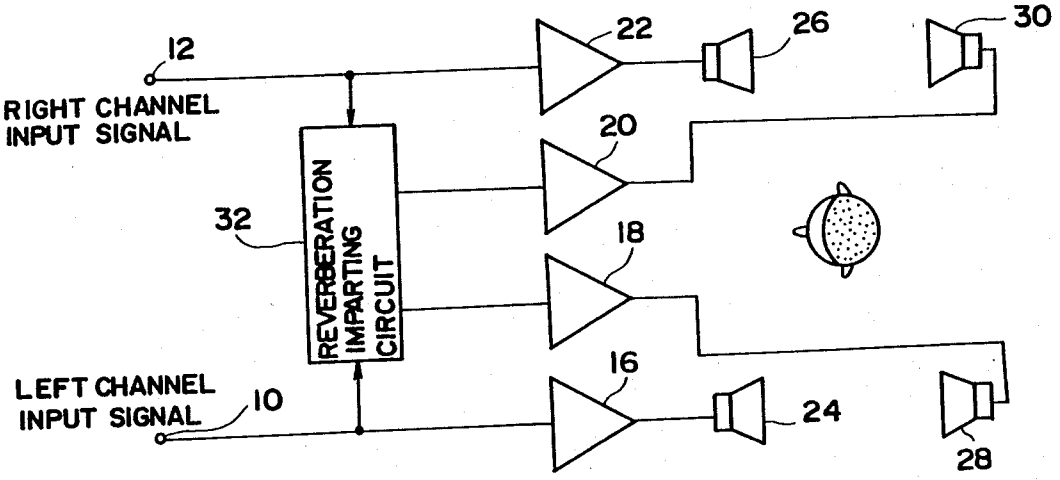
FIG. 3 PRIOR ART
FIG. 3 is a block diagram showing an example of the prior art sound field forming device for producing 4-channel stereophonic signals from 2-channel stereophonic signals.
Figure 9:
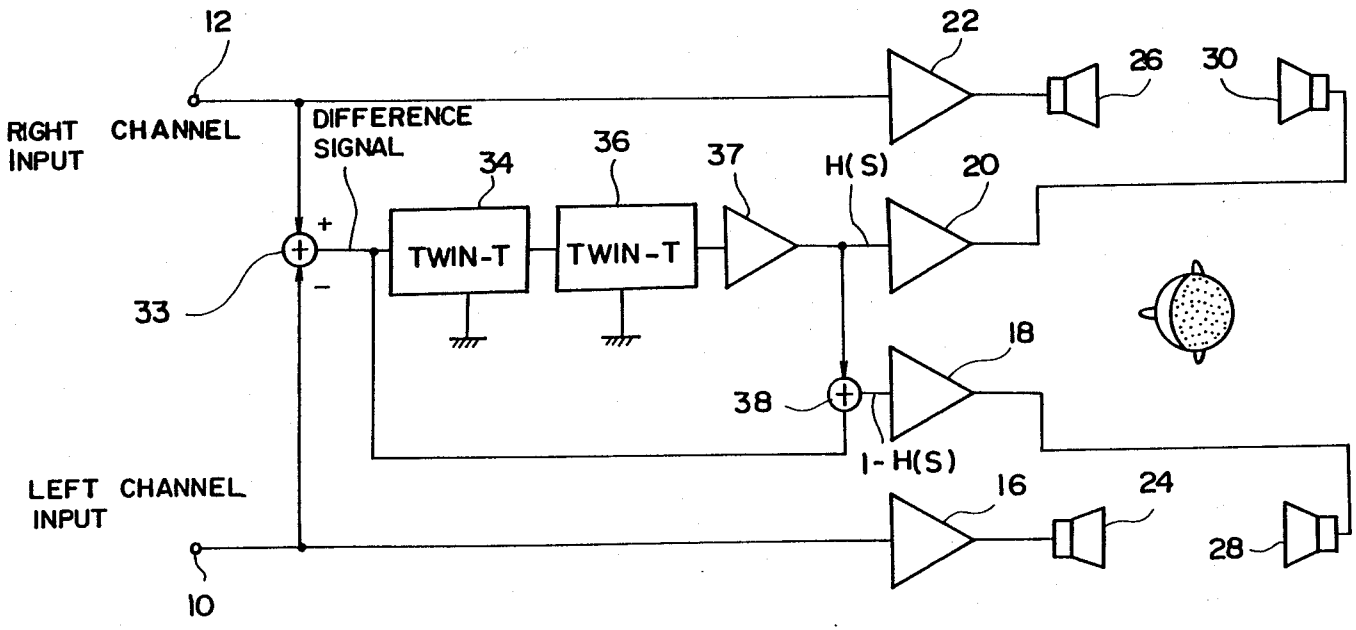
FIG. 9 is a block diagram showing an embodiment of the sound field forming device for producing 4-channel stereophonic signals from 2-channel stereophonic signals according to the invention.

In FIG. 9, the same components as in the prior art circuit shown in FIG. 3 are designated by the same reference characters.

In FIG. 9, a left channel signal of input 2-channel stereophonic signals is applied to an input terminal 10 and a right channel signal to an input terminal 12. These input signals are applied to front left and right channel loudspeakers 24 and 26 through power amplifiers 16 and 22.

The input left and right channel signals are also applied to a subtractor 33 which in turn produces a difference signal between the left and right channel signals. This difference signal contains mainly reverberation component of the input signals and sound components peculiar to the left and right channels distant from a central position. The difference signal thus taken out is applied to two cascade-connected twin-T circuits 34, 36 having different null point frequencies. The output of the twin-T circuits 34, 36 is delivered through a buffer amplifier 37 and applied to a subtractor 38. In the subtractor 38, the output of the buffer amplifier 37 is subtracted from the output signal from the subtractor 33. Thus, the subtractor 38 and the buffer amplifier 37 produce signals 1-H(S) and H(S) having frequency characteristics complementary to each other as shown in FIG. 6(*c*). These signals 1-H(S) and H(S) are supplied to rear left and right channel loudspeakers 28 and 30 through power amplifiers 18 and 20. Accordingly, sounds containing mainly reverberation component and components of sound peculiar to left and right channels distant from a central position in the sounds sounded from the front loudspeakers 24 and 26 are sounded from the rear loudspeakers 28 and 30 whereby 4-channel stereophonic sounds free from unnaturalness and full of feeling of presence is realized.

Figure 10:
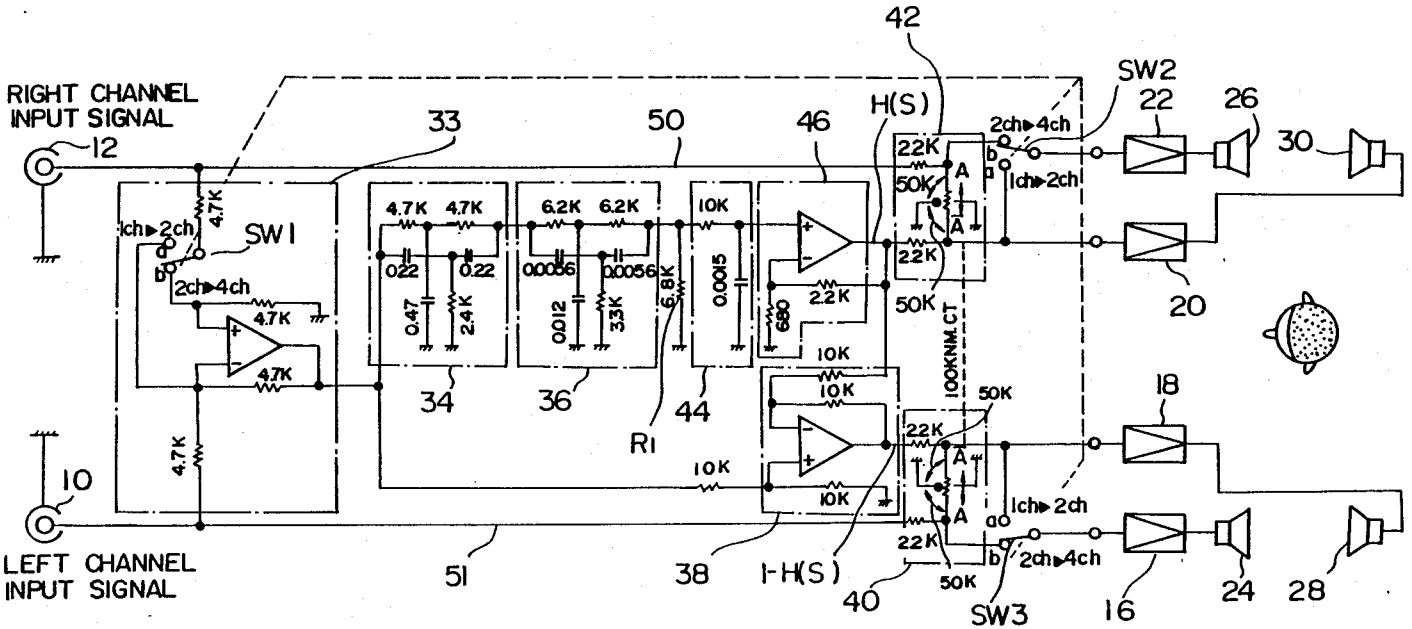
FIG. 10 is a circuit diagram showing a specific example of the circuit of FIG. 9.

A specific example of the circuit of FIG. 9 is shown in FIG. 10. The circuit of FIG. 10 has a function of producing 2-channel signals from a monophonic signal in a simulated fashion in addition to the function of producing 4-channel signals from 2-channel signals in a simulated fashion and one of these functions can be selected by operation of switches. Switches SW1, SW2 and SW3 are provided for this purpose. These switches are interlocked or ganged to one another and contacts a are selected when 2-channel stereophonic signals are produced from a monophonic input signal whereas contacts b are selected when 4-channel signals are produced from 2-channel stereophonic signals. Switching operation for the switches SW1, SW2 and SW3 may be made manually, or automatically in response to detection as to whether the input signal is a monophonic signal or 2-channel stereophonic signals.

Description will firstly be made about a case in which the input signals are 2-channel stereophonic signals.

When the input signals are 2-channel stereophonic signals, the switches SW1, SW2 and SW3 all select the contacts b. The input signal of the left channel is applied to the input terminal 10 and applied directly to a front left channel loudspeaker 24 through attenuator 40, the switch SW3 and a power amplifier 16. The input signal of the right channel is applied to the input terminal 12 and applied directly to a front right channel loudspeaker 26 through an attenuator 42, the switch SW2 and a power amplifier 22.

The input signals of left and right channels are also applied to a subtractor 33 and subtracted one from the other. The output signal of the subtractor 33 is applied to cascade-connected twin-T circuits 34, 36. In the example of FIG. 10 also, the null point frequencies $f_1$ and $f_2$ of the twin-T circuits 34, 36 (see FIG. 6(*a*) are set at $f_1=150$ Hz and $f_2=4.5$ kHz. The signal having passed through the twin-T circuits 34, 36 is delivered out through a low-frequency signal attenuating resistor $R_1$, a low-pass filter 44 and an amplifier 46. The output signal H(S) of the amplifier 46 and the direct signal from the subtractor 33 which has not passed through the twin-T circuits 34, 36 are applied to a subtractor 38 where they are subtracted one from the other. The subtractor 38 therefore produces a signal 1-H(S) having frequency characteristics which is complementary to the output H(S) of the amplifier 46. The output signal of the amplifier 46 is applied to a rear right channel loudspeaker 30 through the attenuator 42 and an amplifier 20. The output signal of the subtractor 38 is applied to a rear left channel loudspeaker 28 through the attenuator 40 and a power amplifier 18. The attenuators 40 and 42 are provided for balancing levels of the front and rear sounds. These attenuators 40 and 42 are interlocked or ganged with each other and, by operating these attenuators in the direction of arrow A, the level of the front sounds is decreased whereas by operating them in the direction of arrow $\overline{A}$, the level of the rear sounds is decreased.

The above mentioned low-frequency signal attenuating resistor $R_1$, the low-pass filter 44 and the amplifier 46 are provided for equalizing the peak values of the respective signals in the respective bands in the same manner as the resistor $R_1$, the low-pass filter 5 and the amplifier 6 in the embodiment shown in FIGS. 4 through 8.

Now description will be made about an operation of the circuit shown in FIG. 10 when a monophonic signal is applied.

When the input signal is a monophonic signal, the switches SW1, SW2 and SW3 all select the contacts a. The monophonic input signal is applied commonly to the input terminals 10 and 12. Since the contacts b of the switches SW2 and SW3 are all opened and signal lines 50 and 51 therefore are interrupted, the monophonic signal applied to the input terminals 10 and 12 is supplied to the subtractor 33 only. The subtractor 33 acts as an adder because the switch SW1 at this time selects the contact a, delivering out the input monophonic signal directly. The output of the subtractor 33 is taken out through the twin-T circuits 34, 36, the low-frequency signal attenuating resistor $R_1$, the low-pass filter 44 and the amplifier 46. The output H(S) of the amplifier 46 is subtracted from the output signal from the subtractor 33 to provide the signal 1-H(S).

The output signal H(S) of the amplifier 46 is applied to the front right channel loudspeaker 26 through the attenuator 42, the switch SW2 and the power amplifier 22. It is also applied to the rear right channel loudspeaker 30 through the attenuator 42 and the power amplifier 20. The output 1-H(S) of the subtractor 38 is applied to the front left channel loudspeaker 24 through the attenuator 40, the switch SW3 and the power amplifier 16 and also to the rear left channel loudspeaker 28 through the attenuator 40 and the power amplifier 18. In this case also, the level of the front and rear sounds may be balanced by operating the interlocked attenuators 40 and 42.

What is claimed is:

1. A sound field forming device comprising:

an input signal terminal for receiving an input signal;

a plurality of cascade-connected twin-T circuits connected to said input terminal and having different null point frequencies;

a low-frequency signal attenuating element connected to an output of said twin-T circuits for facilitating attenuation of a low frequency component of the input signal;

a high-frequency signal attenuating element connected to the output of said twin-T circuits for attenuating a high frequency component of the input signal;

a subtractor for subtracting an output signal of said twin-T circuits derived through said low-frequency and high-frequency signal attenuating elements from the input signal applied to said input signal terminal;

a first output terminal from which the output signal of said twin-T circuits through said low-frequency and high-frequency signal attenuating elements is derived as a first output signal; and a second output terminal from which an output signal of said subtractor is derived as a second output signal.

2. A sound field forming device as defined in claim 1 wherein said low-frequency signal attenuating element attenuates a low frequency signal component below a null point frequency in a low-frequency region of said twin-T circuits.

3. A sound field forming device as defined in claim 1 wherein said high-frequency signal attenuating element attenuates a high frequency signal component above a null point frequency in a high-frequency region of said twin-T circuits.

4. A sound field forming device as defined in claim 2 wherein said low-frequency signal attenuating element is a resistor.

5. A sound field forming device as defined in claim 3 wherein said high-frequency signal attenuating element is a low-pass filter.

6. A sound field forming device as defined in claim 1 further comprising an amplifier for amplifying the output signal of said twin-T circuits derived through said low-frequency and high-frequency signal attenuating elements thereby to equalize peak levels of the output signal of said twin-T circuits and the input signal applied to the input signal terminal which are inputted to said subtractor.

7. A sound field forming device as defined in claim 1 further comprising an attenuating element for attenuating the input signal applied to said input signal terminal to be supplied to said subtractor thereby to equalize peak levels of the output signal of said twin-T circuits and the input signal applied to the input signal terminal which are inputted to said subtractor.

8. A sound field forming device comprising:

a first input terminal;

a second input terminal;

a first output terminal to which an input signal applied to said first input terminal is connected;

a second output terminal to which an input signal applied to said second input terminal is connected;

difference signal generation means connected to said first and second input terminals for generating a difference signal between the two input signals applied to said first and second input terminals;

a plurality of cascade-connected twin-T circuits for receiving and filtering the difference signal from said difference signal generation means, and having different null point frequencies;

a subtractor for subtracting the output signal of said twin-T circuits from said difference signal;

a third output terminal to which the output signal of said twin-T circuits is connected; and a fourth output terminal to which an output signal of said subtractor is connected.

9. A sound field forming device as defined in claim 8 further comprising an amplifier for amplifying the output signal of said twin-T circuits thereby to equalize peak levels of the output signal of said twin-T circuits and the difference signal which are applied to said subtractor.

10. A sound field forming device as defined in claim 8 further comprising an attenuating element for attenuating the difference signal applied to said subtractor thereby to equalize peak levels of the output signal of said twin-T circuits and the difference signal applied to said subtractor.

11. A sound field forming device as defined in claim 8 further comprising:

a first variable resistor connected between said first and third output terminals for controlling balance between two output signals derived from the first and third output terminals; and a second variable resistor connected between said second and fourth output terminals for controlling balance between two output signals derived from the second and fourth output terminals.

12. A sound field forming device as defined in claim 8 further comprising mode changeover switch means capable of being switched, during operation thereof, so as to operate said difference signal generation means as an adder, opening said first and second output terminals and permitting reproduction of the output signals of only said third and fourth output terminals.

* * * * *